US005897248A

United States Patent [19]

Schlueter, Jr. et al.

[11] Patent Number: 5,897,248

[45] Date of Patent: Apr. 27, 1999

[54] CONFORMABLE BIAS TRANSFER MEMBER HAVING CONDUCTIVE FILLER MATERIALS

[75] Inventors: Edward L. Schlueter, Jr., Rochester; Robert A. Gross; Kenneth W. Pietrowski, both of Penfield, all of N.Y.

[73] Assignee: Xerox Corporation, Stamford, Conn.

[21] Appl. No.: 08/263,174

[22] Filed: Jun. 21, 1994

Related U.S. Application Data

[63] Continuation of application No. 08/084,101, Jul. 1, 1993.

[51] Int. Cl.[6] ..... G03G 15/16

[52] U.S. Cl. ..... 399/313; 361/221

[58] Field of Search ..... 355/271, 274, 355/277; 361/221, 225

[56] References Cited

U.S. PATENT DOCUMENTS

| | | | |
|---|---|---|---|
| 3,866,572 | 2/1975 | Gundlach | 118/637 |
| 3,903,043 | 9/1975 | Hillegass et al. | 361/226 X |
| 4,309,803 | 1/1982 | Blaszak | 29/130 |
| 4,764,841 | 8/1988 | Brewington et al. | 361/226 |
| 5,010,370 | 4/1991 | Araya et al. | 355/274 |
| 5,112,708 | 5/1992 | Okunuki et al. | 430/31 |
| 5,150,165 | 9/1992 | Asai | 355/274 |

*Primary Examiner*—William Royer

[57] ABSTRACT

A conformable bias transfer member for use in an electrostatographic printing apparatus comprising a conductive core having a layer of compressible material coated thereon to form a generally cylindrical roll member. The compressible material includes a conductive filler dispersed throughout the interstices thereof for providing conductivity control which is significantly insensitive to changes in temperature as well as relative humidity.

6 Claims, 1 Drawing Sheet

CONFORMABLE BIAS TRANSFER MEMBER HAVING CONDUCTIVE FILLER MATERIALS

Figure 1:
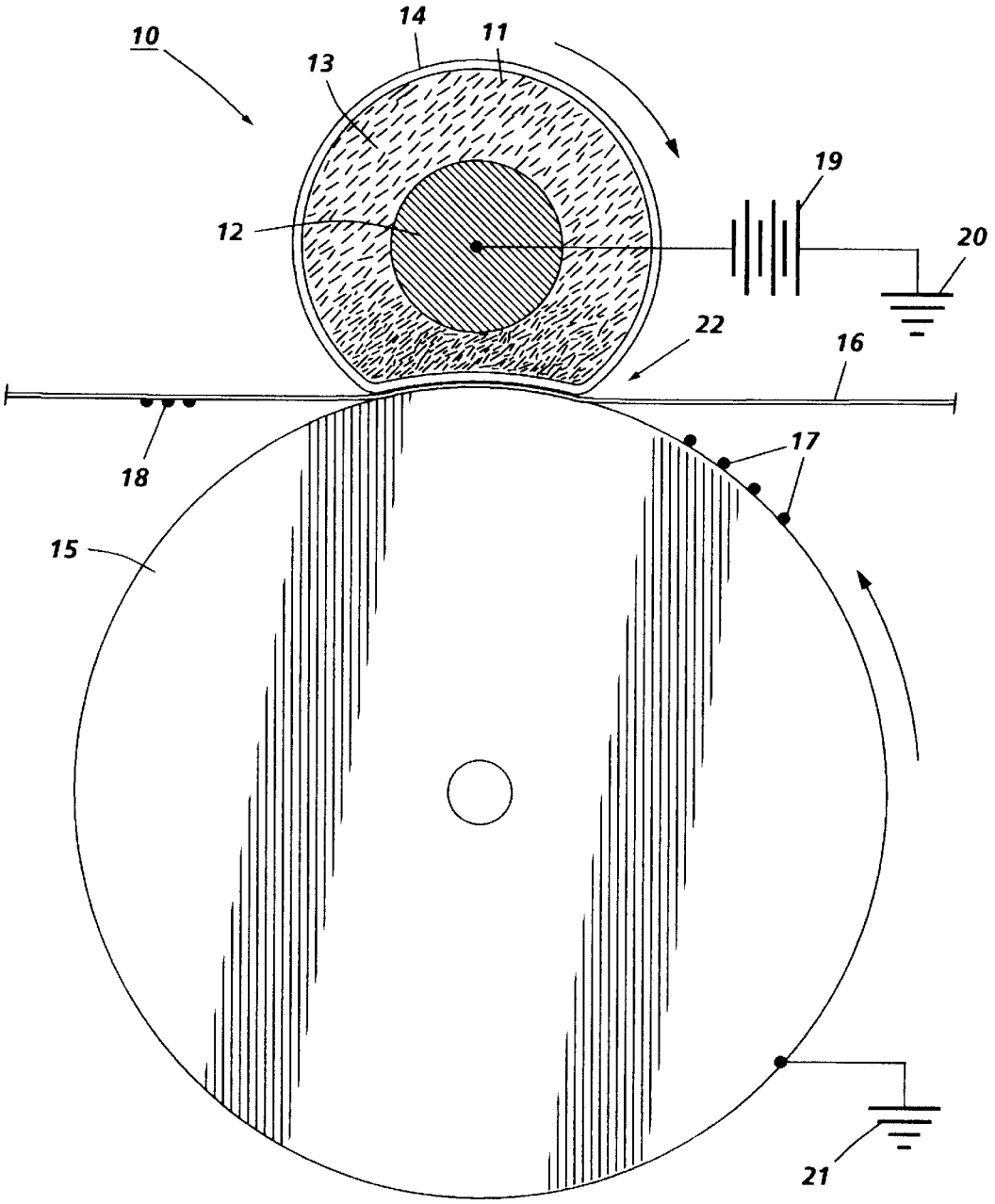

This is a continuation of application Ser. No. 08/084,101, filed Jul. 1, 1993.

The present invention relates generally to an apparatus for transfer of charged toner particles in an electrostatographic printing machine, and more particularly, concerns a conformable transfer member having conductive filler materials for embracing conductivity thereof when compressed.

Generally, the process of electrostatographic copying is initiated by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface. Thereafter, the developing material is transferred from the photoreceptive member to a copy sheet or to some other image support substrate to create an image which may be permanently affixed to the image support substrate, thereby providing an electrophotographic reproduction of the original document. In a final step in the process, the photoconductive surface of the photoreceptive member is cleaned to remove any residual developing material which may be remaining on the surface thereof in preparation for successive imaging cycles.

The electrostatographic copying process described hereinabove is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images.

The operation of transferring developing material from the photoreceptive member to the image support substrate is realized at a transfer station. In a conventional transfer station, transfer is achieved by applying electrostatic force fields in a transfer region sufficient to overcome forces holding the toner particles to the surface of the photoreceptive member. These electrostatic force fields operate to attract and transfer the toner particles over to the copy sheet or other image support substrate. Typically, transfer of toner images between support surfaces is accomplished via electrostatic attraction using a corotron or other corona generating device. In such corona induced transfer systems, the surface of the image support substrate is placed in direct contact with the toner image while the image is supported on the photoreceptive member. Transfer is induced by "spraying" the back of the support substrate with a corona discharge having a polarity opposite that of the toner particles, thereby electrostatically attracting the toner particles to the sheet. An exemplary corotron ion emission transfer system is disclosed in U.S. Pat. No. 2,836,725.

Toner transfer has also been accomplished successfully via biased roll transfer systems. This type of transfer apparatus was first described by Fitch in U.S. Pat. No. 2,807,233, which disclosed the use of a metal roll coated with a resilient coating having an approximate resistivity of at least $10^6$ ohm-cm, providing a means for controlling the magnetic and non-magnetic forces acting on the toner particles during the transfer process. Bias roll transfer has become the transfer method of choice in many state-of-the-art xerographic copying systems and apparatus, as can be found, for example, in the Model 9000 Series of machines manufactured by Xerox Corporation. Notable examples of bias roll transfer systems are described in U.S. Pat. No. 3,702,482 by C. Dolcimacsolo et al, and U.S. Pat. No. 3,782,205, issued to T. Meagher. Other general examples of bias roll transfer systems can be found in U.S. Patent Nos. 3,043,684; 3,267,840; 3,328,193; 3,598,580; 3,525,146; 3,630,5911, 3,684,364; 3,691,992; 3,832,055; and 3,847,478, among others.

As described, the process of transferring development materials via a bias roll transfer system in an electrostatographic apparatus involves the physical detachment and transfer over of charged particulate toner material from a first image support surface (i.e., a photoreceptor) into attachment with a second image support substrate (i.e., a copy sheet) under the influence of electrostatic force fields generated by an electrically biased roll member as well as charge being deposited on the second image support substrate. The previously referenced patent to Fitch indicates the utility for a roller configured so as to include an inner conductive member having a layer of high electrical resistance material, for transferring a toner powder image from the photoreceptor drum onto a print receiving web. That patent also discloses the use of such a roller member for charging the photoreceptor drum prior to the exposure of the original document to form an electrostatic latent image on the drum. Thus, roll members to which the present invention pertains have various uses in the electrostatographic process.

The critical aspect of the transfer process focuses on maintaining the same pattern and intensity of electrostatic fields as on the original latent electrostatic image being reproduced to induce transfer without causing scattering or smearing of the developer material. This essential and difficult criterion is satisfied by careful control of the electrostatic fields, which, by necessity, must be high enough to effect toner transfer while being low enough so as not to cause arcing or excessive ionization at undesired locations. Such electrical disturbances can create copy or print defects by inhibiting toner transfer or by inducing uncontrolled transfer which can easily cause scattering or smearing of the development materials.

The problems associated with successful image transfer are well known. In the pretransfer air gap region, or the so-called prenip region immediately in advance of copy sheet contact with the image, excessively high transfer fields can result in premature transfer across the air gap, leading to decreased resolution or blurred images. High transfer fields in the prenip air gap can also cause ionization, which may lead to loss of transfer efficiency, strobing or other image defects, and a lower latitude of system operating parameters. Conversely, in the post transfer air gap region or the so-called postnip region at the photoconductor-copy sheet separation area, insufficient transfer fields can give rise to image dropout and may generate hollow characters. Improper ionization in the postnip region may also create image stability defects and can give rise to copy sheet separation problems. Of course, the overriding consideration in providing an effective transfer system must focus on the transfer field generated in the transfer region which must be maximized in the area directly adjacent the transfer nip where the copy paper contacts the image so that high transfer efficiency and stable transfer can be achieved.

Variations in ambient environmental conditions, copy paper resistivity, contaminants, and field strength can all affect prerequisite transfer parameters. Further, in bias transfer roll systems, conduction of the bias charge from the roll member is greatly affected by the magnitude of transfer current through, as well as the conductivity of, the material making up the bias roll member.

Typically, bias transfer members take the form of a cylindrical member comprised of a polyester based elastomeric polyurethane. Further, it has been shown that the resistivity of the elastomeric resilient polyurethane coating on biasable members can be controlled by ionic additives incorporated into the polyurethane. For example, organic salts, and specifically, tetraheptyl ammonium bromide (THAB), have been used in bias system transfer components to attain specific resistivity levels. Prior art systems disclosing the use of ionic additives include U.S. Pat. No. 3,959,574 to Seanor, et al and U.S. Pat. No. 4,116,894 to Lentz et al, among others.

While the polyester based polyurethanes containing ionic charge control additives have been utilized with relative success, these systems have been found to have many shortcomings. Primarily, as transfer current flows through the polyurethane material of the bias transfer member, the charge control additives therein tend to migrate toward the source of biasing potential, thereby depleting the concentration of the ionic charge control additives over a cross section of the polyurethane material and increasing the resistivity thereof. This is believed to be due to the fact that presently used materials generate conduction by rotation of the polymer chain, effective crosslinking, and conductive additives. However, present systems are very low crosslinked systems and, therefore, the additives have high mobility and are very easily transported through the elastomer network, resulting in the diffusion of the charged components and accordingly, reduction in the conductivity of the transfer member. Further, these ionic additive based systems are highly sensitive to relative humidity and temperature such that resistivity also increases as a function of relative humidity and temperature. An increase in resistivity causes the bias voltage across the transfer roll member to increase when maintaining a constant transfer current, thereby leading to a transfer system failure. Resultant increased voltages shorten the electrical life of the bias transfer member and complicate hardware design, adding to the expense of the electrostatographic system.

Various approaches and solutions to the problems associated with the use of bias transfer rolls and specifically directed toward the issue of providing more effective materials for incorporation into bias transfer roll systems have been proposed. The following disclosures may be relevant to various aspects of the present invention:

U.S. Pat No. 3,866,572
Patentee: Gundlach
Issued: Feb. 18, 1975
U.S. Pat. No. 4,309,803
Patentee: Blaszak
Issued: Jan. 12, 1982

The relevant portions of the foregoing disclosures may be briefly summarized as follows:

U.S. Pat. No. 3,866,572 discloses a foraminous electrostatographic transfer system with a roller electrode having an electrically conductive core, such as a solid metal roller, a thick layer of foraminous open-cell material, such as open celled polyurethane foam, and an outer coating, such as a ten mil layer of polyurethane.

U.S. Pat. No. 4,309,803 discloses a conformable foam roll for use in electrostatographic reproducing processes and machines, and an inexpensive method for making such a roll. The foam roll is made of a conductive core which is made of a paper base having a layer of conductive material thereon, a compressible foam layer formed on the core, and a smooth exterior surface layer covering the foam layer. That patent further discloses that the foam layer may include an ionic charge control additive which is incorporated into the foam formulation to decrease the electrical resistivity of the foam material.

In accordance with one aspect of the present invention, a conformable roll member is provided, comprising a conductive core and a layer of compressible material radially surrounding the core, wherein the compressible layer includes a conductive filler material.

In accordance with another aspect of the present invention, a biasable transfer roll system for transferring toner particles from an image support surface to a copy substrate is provided, including a conformable roll member comprising an electrically conductive core member and a layer of compressible material covering the core member, the layer of compressible material including an electronically conductive filler for conductivity control.

In accordance with yet another aspect of the present invention, an electrostatographic printing apparatus is disclosed, including a conformable roll member comprising a conductive core and a layer of compressible material radically surrounding the core, wherein the compressible layer includes a conductive filler.

These and other aspects of the present invention will become apparent from the following description in conjunction with the accompanying drawings in which the FIGURE shows the novel conformable roll of the present invention in a transfer mode, as may be found in a typical electrostatographic copying process.

As indicated hereinabove, the present invention provides a novel roll member for use in an electrostatographic printing machine, wherein the roll member has an inner conductive core and an external resistive coating layer comprising an electrically conductive filler. While the present invention will be described with reference a preferred embodiment thereof, it will be understood that the invention is not limited to this preferred embodiment. On the contrary, it is intended that the present invention cover all alternatives, modifications, and equivalents as may be included within the spirit and scope of the invention as defined by the appended claims. Other aspects and features of the present invention will become apparent as the description proceeds.

Referring to the FIGURE it may be seen that the present invention provides a conformable bias transfer roll system which cooperatively improves an otherwise conventional electrostatographic transfer system, the details of which are well known in the art and are taught in the cited references disclosing bias roller transfer systems which are hereby incorporated by reference into the present invention. Since the details of such conventional transfer systems are fully described in the above incorporated references, the details of bias roller transfer systems will not be described in detail herein. Moreover, one of skill in the art will recognize that the roller member of the present invention has more than one possible use in an electrostatographic processing system. It will be understood that, although the present invention will be described in the context of a transfer system, this invention may also be incorporated into other electrostatographic machine subsystems, such as, for example, but not limited to, the charging system of a typical electrostatographic apparatus.

Referring now specifically to the FIGURE, a conformable roll member 10 in accordance with the present invention is shown in the configuration of a transfer system of a typical electrostatographic printing machine. As can be seen from FIG. 1, the conformable roll 10 of the present invention includes a conductive core 12 connected to a biasing source, which in this case, includes a DC voltage source 19 coupled to ground 20. A drum-type photoconductive insulating surface 15 is shown in operative engagement with the conformable roll 10, forming a nip 22 therebetween. A powdertoner image 17 previously formed and developed in accordance with convention electrostatographic copying processes is present on the surface of the photoconductive insulating drum. A copy sheet 16 or other support substrate travels through the nip 22 formed in the area of contact between the semi conductive conformable roll 10 and the photoconductive insulating surface 15 for receiving the powder toner image 17 from drum 15. Thus, the powder toner image is transferred to the support sheet 16, appearing as a transferred image 18 thereon, by operation and inducement of the transfer roller 10. The physics involved in using a conformable roll for the transferring process in such an electrostatographic printing apparatus is discussed in detail in U.S. Pat. No. 3,866,572 to Gundlach, incorporated by reference herein. The transferred image 18 on the support sheet 16 may be subsequently processed, for example, by fusing the image onto the support sheet.

It will be seen from the FIGURE that the conformable roll 10 comprises a layer of compressible material 13 coated onto conductive core 12. The roll member 10 is normally cylindrical with the layer 13 uniformly surrounding the central core 12 in a coaxial manner. The layer is comprised of a polyurethane formulation or any other substantially resistive material capable of providing desirable resistivity and compressibility characteristics. This formulation may be closed cell or open cell, i.e., a foam material, which is sufficiently compressible, preferably having resistivity on the order of $10^9$. In addition, a peripheral surface layer or seal coating 14 may also be provided along the circumferential exterior surface of the roll 10. The seal coating 14 is sufficiently elastic and resilient to yield to the compressible characteristics of the conformable underlying layer 13. This seal coating 14 is optional and may be provided for wear resistance, cleanability and insulative properties as required for operation of the transfer system. It will be appreciated that a conformable roll 10 is subjected to a compressive force in the nip 22 formed in the area of contact between the roll 10 and the photoconductive drum 15. This compressive force causes the compression of the conformable roll such that the conductive core 12 of the roll 10 is brought into much closer proximity to the photoconductive surface 15, upon which the powder toner image is located.

An important feature of the present invention is found in the fact that the compressible layer 13 of the bias transfer roll 10 includes a conductive filler material dispersed throughout the interstices thereof, depicted graphically as particles identified by reference numeral 11, which may include for example, carbon black particles, alumina metal powders, graphite filings, particles of any other satisfactory conductive material. The conductive filler material 11 is provided in a concentration level of approximately 5 to 40 parts by weight so as to maintain the resistive or insulative properties of the bias transfer roll 10 in its noncompressed configuration while substantially decreasing the resistivity of the bias transfer roll 10 in its compressed state, such decrease in resistivity being caused by increased contact between the conductive filler particles 11 in the transfer roll 10. Thus, with respect to the present invention, compression of the transfer roll member 10 in the nip 22 area causes the conductive filler particles 11 to contact one another providing a conductive path between the conductive core 12 and the transfer nip 22, thereby generating an increase in the field intensity in the nip region.

In contrast with known bias transfer systems having an ionic charge control agent incorporated therein, for example, tetraheptyl ammonium bromide (THAB) which are generally known and incorporated into the formulation of the outer coating of a bias transfer roll, the combination of a compressible roller having conductive fillers introduced into the formulation of the coating layer as provided by the present invention, yields many benefits and advantages. Thus, the concept provided by the present invention for using electronic conductive fillers to provide conductivity control is preferable over known techniques for providing ionic charge control additives to produce conductivity control in that the volume resistivity controlled by the electronic conduction is significantly less sensitive to changes in temperature and relative humidity than ionic charge control additives. Further, although bulk conductivity is extremely sensitive to the concentration of the electronic filler in the desired range of conductivity associated with bias transfer roll applications, causing fabrication to a tight conductivity specification extremely difficult, the disclosed combination of a compressible roller having conductive filler is less sensitive to filler concentration so that it is more practical to provide conductive fillers at the concentration level desired. In addition, conductivity of the bias transfer roll device can be controlled by varying the compression characteristics of the coating layer 13 in the transfer nip 22.

It will be appreciated from the present description that compression of the bias transfer roll coating layer 13 in the transfer nip 22 will increase the device conductivity such that higher transfer fields can be applied to achieve high transfer efficiencies. The conductive filler material 11 is provided in concentration levels such that the conductivity thereof is insufficient to produce breakdown at the bias voltage applied in areas outside the transfer nip.

It is, therefore, evident that there has been provided, in accordance, with the present invention, a biasable transfer roll device that fully satisfies the aims and advantages of the invention as hereinabove set forth. While the invention has been described in conjunction with preferred embodiments thereof, it is evident that many alternatives, modifications, and variations may be apparent to those skilled in the art. Accordingly, the present application for patent is intended to embrace all such alternatives, modifications, and variations as are within the broad scope and spirit of the appended claims.

We claim:

1. An electrically biasable transfer roll system for transferring toner particles from an image support surface to a copy substrate in a transfer region formed in an area of contact therebetween, comprising:

a conformable roll member, including a conductive core; and a layer of compressible material uniformly surrounding said core, wherein said layer of compressible material includes conductive particles dispersed throughout for providing said conformable roll member with a resistivity;

said conformable roll member being compressed in said transfer region for causing the conductive particles dispersed throughout said layer of compressible material to contact one another so as to substantially decrease the resistivity of said conformable roll member in the transfer region while maintaining the resistivity thereof in regions outside of the transfer region.

2. The electrically biasable transfer roll system of claim 1, wherein said layer of compressible material is comprised of a polyurethane formulation.

3. The electrically biasable transfer roll system of claim 1, wherein said conductive particles are selected from a group consisting of carbon black alumina, graphite, and mixtures thereof.

4. The electrically biasable transfer roll system of claim 1, wherein said conformable roll member includes a peripheral surface layer positioned along a circumference of said conformable roll member.

5. The electrically biasable transfer roll system of claim 1, wherein said conductive particles are present in a concentration ranging from approximately 5 to 40 parts by weight.

6. An electrostatographic printing apparatus having including an electrically biasable transfer roll system for transferring toner particles from an image support surface to a copy substrate in transfer region formed in an area of contact therebetween, comprising:

a conformable roll member, including a conductive core; and a layer of compressible material uniformly surrounding said core, wherein said layer of compressible material includes conductive particles dispersed throughout for providing said conformable roll member with a resistivity;

said conformable roll member being compressed in said transfer region for causing the conductive particles dispersed throughout said layer of compressible material to contact one another so as to substantially decrease the resistivity of said conformable roll member in the transfer region while maintaining the resistivity thereof in regions outside of the transfer region.

* * * * *